United States Patent [19]
Keen

[11] 3,934,443
[45] Jan. 27, 1976

[54] PEENING TOOL

[76] Inventor: David P. Keen, 2115 Robinson St., Redondo Beach, Calif. 90278

[22] Filed: Jan. 3, 1975

[21] Appl. No.: 538,301

[52] U.S. Cl. ..... 72/75; 72/76
[51] Int. Cl.[2] ..... B21J 7/16
[58] Field of Search ..... 72/75, 76, 120; 173/94; 308/6 B, 201; 29/148.4 C

[56] References Cited

UNITED STATES PATENTS

| | | | |
|---|---|---|---|
| 924,440 | 6/1909 | Dowell | 29/148.4 |
| 1,278,359 | 9/1918 | Lane | 173/94 |
| 1,920,102 | 7/1933 | Nolan | 29/148.4 |
| 3,239,282 | 3/1966 | Schroll et al | 308/201 |
| 3,266,825 | 8/1966 | Magorien | 308/201 |
| 3,444,714 | 5/1969 | Gustkey | 72/76 |
| 3,517,533 | 6/1970 | Koznar | 72/76 |
| 3,610,008 | 10/1971 | Foedisch | 72/76 |

*Primary Examiner*—Lowell A. Larson
*Attorney, Agent, or Firm*—Singer & Singer

[57] ABSTRACT

An improved peening tool comprising a cylindrical body having a plurality of holes each adapted to receive a spherically shaped ball bearing. A sleeve member having a plurality of holes is located over the cylindrical body so that each hole in said sleeve is aligned with the hole in said cylindrical body. The diameter of the hole in the sleeve is less than the diameter of the spherically shaped ball. A rotatable driver body is located within said cylindrical body and contains an even number of individual rotatable hammers adapted to sequentially contact said spherical balls. During operation each hammer is free to rotate about its own axis thereby presenting a new contacting point for moving the spherical balls.

18 Claims, 7 Drawing Figures

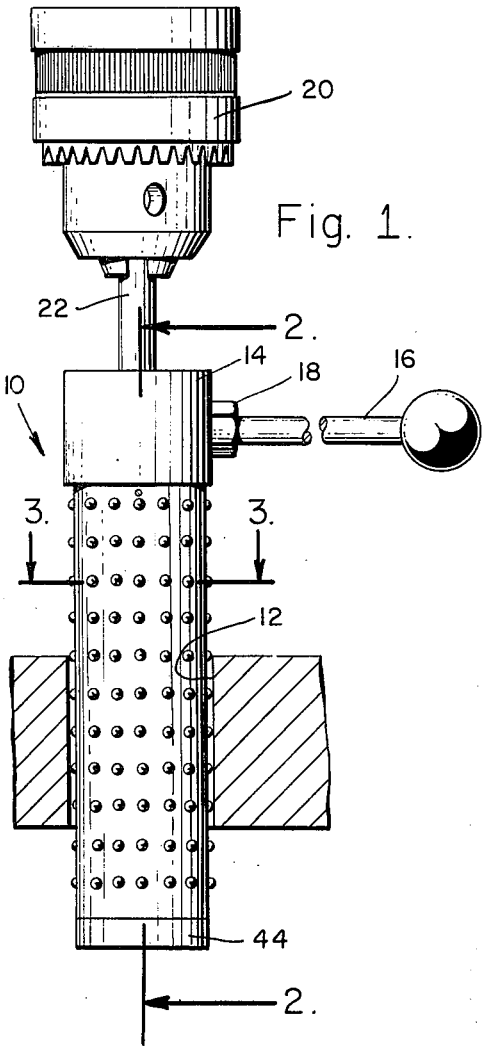
Fig. 1.
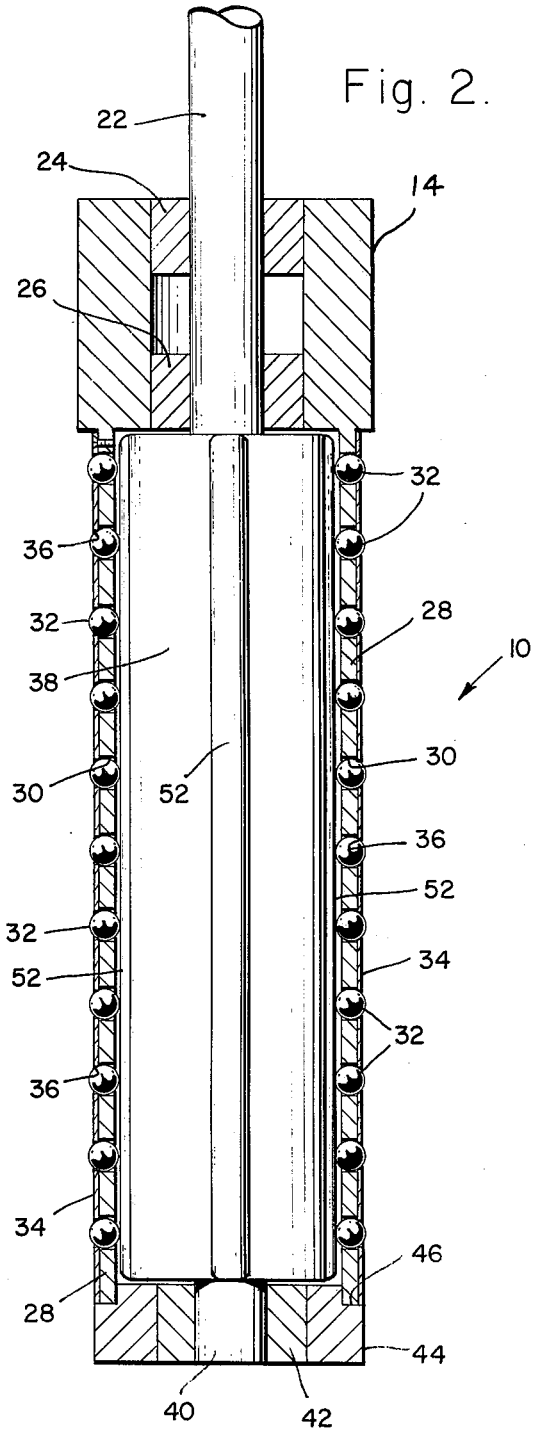
Fig. 2.
Fig. 4.
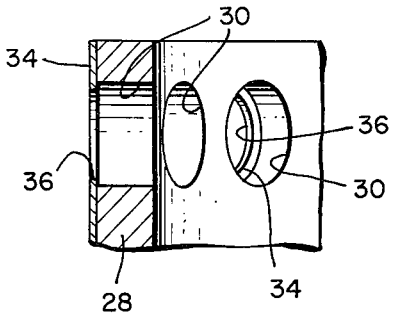

PEENING TOOL

This invention relates to an improved peening tool and more specifically to a peening tool that is constructed of a reduced number of parts and is more adapted to sustain punishment resulting from the peening activities.

The prior art has shown that the quality of surface metals is improved by the process of shot peening the surface of the metal. The process of shot peening requires that the surface material be impacted by spherically shaped steel ball bearings at right angles to the surface so as to impact the surface of the metal in a direction normal to the surface.

The specific techniques of shot peening large surfaces of metal have resulted in the surface metal being stronger and less resistent to fatigue, cracks and failures than surface metal that has not been subjected to shot peening methods. One theory indicates that the surface of the metal is compressed which has the effect of surface hardening the material by a plurality of hemispherical impressions. These hemispherical impressions not only harden the surface of the material but also prevent fatigue, cracks and other imperfections in the surface from propagating through the surface so as to cause a catastrophic failure of the metal.

Tests have shown that a peened surface has the effect of localizing cracks and fatigues at each spherical indentation. The net effect is that a peened surface can withstand more stress and fatigue without failure than an untreated surface material can stand.

The process of peening a metal surface to improve the strength of the material is not limited to a broad surface nor is it limited to any specific kind of metal. Peening of metal surfaces used in aircraft construction has been recognized as a necessary expedient which increases the strength of the aircraft without necessarily increasing or adding weight to the aircraft members.

The main structures of modern aircraft, which include both military and commercial, now includes special castings for joining the fuselage sections to the main spars and to the retractable wheel support members. These castings form the backbone of the aircraft and are subjected to the shot peening techniques mentioned above.

The benefits of shot peening a casting not only include the external surfaces of the casting but also include the internal diameters of the many blind holes located in any given casting. The problems associated with properly peening the internal diameters of the castings is the subject matter of the present invention.

The prior art has recognized that in order to properly peen the internal diameters of a blind hole in a casting that it is necessary to supply a hand-held tool having a plurality of spherical balls held in a preferred position that is normal to the walls of the hole to be peened. Proper peening action requires an internal hammer to selectively strike the ball and move the ball into contact with the internal diameter of the blind hole so as to produce the spherical indentation on the internal diameter which is necessary to obtain the benefits of the peening action.

A review of the prior art will show that on Oct. 5, 1971, U.S. Pat. No. 3,610,008 entitled Peening Tool was issued to A. K. Foedisch. The Foedisch patent describes apparatus for peening the inside diameter of a hole. The problem of holding the individual steel ball bearings forming the peening tools is solved by Foedisch by creating a plurality of pair of raceways in which each pair traps a plurality of steel ball bearings. The assembly comprising the plurality of pairs of raceways is held together by pins in an attempt to create a unitary structure.

A centrally located hammer portion contains a scalloped edge in which the high points are adapted to contact the individual ball bearings thereby forcing the ball bearings radially into the internal diameter surface of the cylinder being peened.

The Foedisch patent represents a best state-of-the-art technique for peening the internal diameter of a cylinder. Unfortunately the large number of parts necessary to construct the Foedisch tool created a tool that was excessively expensive and had a limited useful life in the field. The forces generated by the hammer on the steel ball bearings continually loosen the pin structure holding the plurality of pairs of raceways together. Unfortunately the forces generated during the peening action tend to loosen the structure thereby reducing the efficiency of the peening tool and eventually allowing the individual ball bearings to move from their preferred position thereby disrupting operation of the peening device.

The prior art also discloses in U.S. Pat. No. 2,442,009, patented May 25, 1948 to John E. Kline, a peening device also utilizing a plurality of ball bearings as the peening instrument. Here again the problem of holding the individual ball bearings is solved by utilizing a plurality of raceways bound together to hold the ball bearings in the defined relationship.

The peening operation should be differentiated from a burnishing or rolling operation which is used in the industry as a means of finishing either external surfaces or internal surfaces to a preferred diameter. A burnishing or rolling operation is more fully described in U.S. Pat. No. 3,517,533 to J. Koznar which discloses the use of ball bearings in a rolling operation to finish outside diameter cylinders and also internal diameter cylinders to a predetermined diameter.

The peening operation requires an impacting of the peening tool at right angles or normal to the surface of the cylinder being peened. The surface must obtain a plurality of individual and discrete indentations caused by the peening tool in order to achieve the benefits resulting from the peening operation. The burnishing or rolling operation on the other hand is more akin to a cold rolling operation in which pressure of the individual ball bearings or rollers used against the surface of the material being treated is continuous and does not leave a plurality of individual discrete indentations as is so essential to the peening operation. It will be appreciated therefore that a peening operation must by necessity use discrete elements and cannot be achieved by a continuous application of a roller or continuous application of ball bearing elements.

In the present invention there is disclosed an improved peening tool utilizing a plurality of discrete ball bearing elements held in a single structural cylindrical body. The ball bearings are located in a plurality of individual holes of equal thickness located radially in the cylindrical body. The diameter of the individual holes is slightly larger than the diameter of the ball bearing in order to allow the ball bearing to move freely within the confines of the individual hole.

In the preferred embodiment a sleeve member having a plurality of reduced diameter holes is located coaxially over the cylindrical body. The sleeve is positioned so that each reduced diameter hole in the sleeve is juxtaposed over the corresponding larger diameter hole on the individual body. The reduced diameter of each of the holes in the sleeve member is slightly smaller than the diameter of the individual ball bearing thereby trapping the ball bearing within the hole located in the cylindrical body. The sleeve member is fixedly attached to the cylindrical body preferably by locating pins and by suitable soldering techniques to thereby insure that the sleeve member maintains a fixed and rigid position with respect to the cylindrical body. Other techniques such as creating an interference fit may be used to maintain the fixed relationship between the sleeve member and the cylindrical body.

A rotatable driver body is located within the hollow cylindrical body. The driver body contains a number of hammer members located in keyways on the periphery of the driver body. In the preferred embodiment each hammer portion is created in the form of a cylindrical steel pin located in a keyway that is slightly oversize with respect to the diameter of the steel pin.

The dimension of the steel hammer pins and the diameter of the driver body is chosen so that the individual hammer pins upon contacting the steel balls force the steel balls in an outward radial direction a distance beyond the external diameter of a sleeve member but at the same time without causing the steel ball to contact the reduced diameter hole located within the sleeve member.

It will be appreciated by those skilled in the art that the sleeve member forms the function of only trapping the steel ball and does not perform the function of holding the ball against the force exerted by the hammer pin when contacting the ball during the peening operation. In this fashion there is no wear upon the sleeve member and as a result the balls are held in place by the cylindrical body.

Further objects and advantages of the present invention will be made more apparent by referring now to the accompanying drawings wherein:

FIG. 1 illustrates the portable improved peening tool;

FIG. 2 is a cross-sectional view taken along lines 2—2 of FIG. 1;

FIG. 4 is a partial exploded view of the peening tool body;

Figure 3:
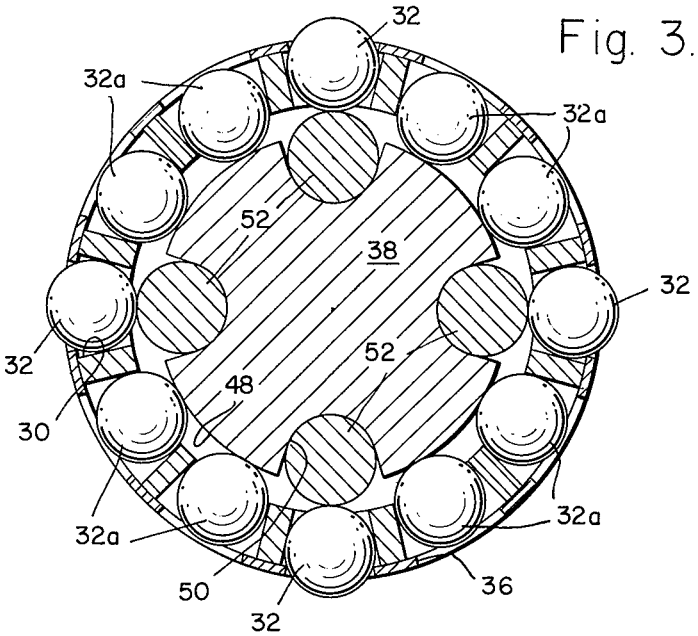
FIG. 3 is a cross-sectional view taken along lines 3—3 of FIG. 1.

Referring now to FIG. 1, there is shown a peening tool 10 located within a cylinder 12 to be peened.

The peening tool 10 has a main body portion 14 containing a handle 16 which is threadedly engaged and locked to the main body portion by means of a suitable lock nut 18.

A suitable rotary driving device 20 which may be either a pneumatic operated device or an electrical operated device is connected to a shaft 22 which forms an intrical portion of the peening tool 10.

Referring now to FIG. 2, there is shown a crosssectional view of FIG. 1 taken along lines 2—2 of FIG. 1.

The main body portion 14 comprises at one end a relatively thick cylindrical portion containing a pair of split bearings 24 and 26. The other end of the main body portion 14 comprises a hollow cylindrical body 28 constructed from the same block material forming the main body portion 14.

The hollow cylindrical body 28 contains a plurality of equal diameter holes 30 located radially in said cylindrical body. A spherically shaped ball, preferably a steel ball bearing 32, is located in each of the holes 30 located in the hollow cylindrical body 28. The diameter of each of the balls 32 is less than the diameter of the holes 30 in order to allow the balls to freely move within the hole 30.

A relatively thin shelled hollow cylindrical sleeve member 34 having a plurality of reduced diameter holes 36 is located on the periphery of the main body portion 28. The sleeve member 34 contains the same number of holes 36 as contained on the hollow cylindrical body 28.

The sleeve member 34 has an internal diameter approximating the external diameter of the hollow cylindrical body 28 thereby allowing the sleeve member to be located coaxially over the cylindrical body and positioned so that each reduced diameter hole 36 on the sleeve member is juxtaposed over the larger diameter hole 32 located on the hollow cylindrical body 28. The sleeve member 34 is fixedly attached to the hollow cylindrical body 28 in a manner consistent with the state-of-the-art. In the preferred embodiment the internal diameter of the sleeve member 34 was made approximately two thousandths larger than the external diameter of the hollow cylindrical body 28 to facilitate a close fit of the sleeve member over the cylindrical body. Conventional silver soldering fixedly attaches the sleeve member to the body after the holes 36 on the sleeve member are aligned with the holes 30 located on the cylindrical body 28. It is also envisioned that an interference fit may be used while the sleeve member 34 is heated and the cylindrical body 28 is cooled thereby providing a fixedly attached configuration without the necessity of soldering or other mechanical devices.

The reduced diameter holes 36 have a diameter that is smaller than the diameter of the balls 32 thereby effectively preventing the individual balls from falling out of the cylindrical body 28. The dimensional relationship is such that the diameter of the individual ball 32 must be greater than the combined thickness of the cylindrical body 28 and the thickness of the sleeve member 34.

Located within the peening tool 10 is a driver body 38 attached to the driving shaft 22 at one end and to a stud shaft 40 at the other end. The drive shaft 22 is supported by the bearings 24 and 26 located within the main body portion 14. The stud shaft 40 is supported by a bearing 42 located within a collar 44. The bearing 42 is press fit within the collar 44 so as to present a unitary structure and solid support for stud shaft 40.

The collar 44 contains a circular shoulder 46 adapted to receive and hold the end portion of the hollow cylindrical body 28 and the sleeve member 34. The shoulder 46 acts to centrally align the collar 44 within the cylindrical opening of the body 28 and assures the alignment of the stud shaft 40 with the drive shaft 22. The collar 44 is fixedly attached to the cylindrical body 28 and the sleeve 34 in order to insure a unitary structure that maintains alignment during operation of the peening tool. In a preferred embodiment the collar 44 is attached to the body 28 by means of soldering techniques or by means of suitably placed set screws located within the shoulder 44 engaging the end portions of the cylindrical body 28.

The drive body 38 contains a plurality of hammer pins that are adapted to contact the balls 32 as the driver body is rotated by means of the drive shaft 22. Details of the driver body and the plurality of hammer pins is more fully illustrated and described in connection with FIGS. 3, 5, 6 and 7.

Referring now to FIG. 4, there is shown an exploded view of a portion of the hollow cylindrical body 28 and the sleeve member 34. The equal diameter holes 30 located in the cylindrical body 28 capable of accepting the balls 32 is more fully illustrated as is the reduced diameter hole 36 located on the sleeve member 34. As mentioned previously the diameter of hole 30 is larger than the diameter of the ball to allow the ball free movement within the hole 30 whereas the diameter of the hole 36 is approximately twelve thousandths less than the diameter of the ball, thereby effectively preventing the ball from passing through the hole 36 located in the sleeve member 34.

The problems overcome by the present invention are concerned primarily with the creation of a solid unitary cylindrical body 38 having a reduced opening on the periphery which effectively captures the balls within the openings in the body 28 without affecting or otherwise interfering with the movement of the balls within the openings provided. It is contemplated that in the further practice of the invention the sleeve 34 may be eliminated by creating a single hollow cylindrical body 28 having a reduced diameter along the external periphery that is sufficient to prevent the ball from passing through the opening in the body. Injection molding and casting techniques are presently within the state-of-the-art that would allow a single unitary structure to be cast having a reduced diameter on the peripheral portion and serving the function of the sleeve member 34.

Referring now to FIG. 3, there is shown a cross-section taken along lines 3—3 of FIG. 1. The driver body 38 is shown located within the hollow cylindrical body 28 and the individual balls 32 are each shown located in position within the equal diameter holes 30 located along the periphery of the cylindrical body 28.

The driver body 38 consists of a single cylindrical body 48 having a plurality of keyways 50 located near the periphery of the body 50. The keyways 50 are preferably cylindrical and extend the length of the body 38.

Located within each keyway 50 is a key 52 having the same general shape as the keyway 50. In the preferred embodiment the keyway 50 is constructed cylindrically and similarly the key 52 is constructed of the same cylindrical shape but having a diameter that is approximately two to three thousandths of an inch less than the diameter of the cylindrical keyway 50. In this manner the individual cylindrical keys 52 nest within the cylindrical keyways 50 and are free to move when the body 48 is rotated. By constructing the cylindrical keys 52 of a smaller diameter than the cylindrical keyways 50 the individual keys are free to rotate within the cylindrical keyways during rotation of the body 38.

The external diameter 48 of the body 38 is selected to provide sufficient clearance between the internal diameter of the hollow cylindrical body 28 and also large enough to contact the individual balls 32a so as to prevent the individual balls 32a from leaving the hole 30 located in the cylindrical body 28.

In addition, the position of the cylindrical keyway 50 and the diameter of the cylindrical key 52 is selected so that contacting of the periphery of the cylindrical key 52 on a corresponding ball 32 will forcibly move the ball 32 radially away in an outward direction, a distance that is less than the distance necessary to cause the ball to strike the reduced diameter hole 36 located on the sleeve 34.

In other words, during operation of the peening tool, the individual cylindrical keys 52, sometimes referred to as hammers or hammer pins, forcibly contact and move the individual balls 32 a given distance to produce the peening action on the internal wall of the workpiece being peened. The total movement of the ball 32 is such that the ball does not contact the reduced diameter 36 and hence it will be appreciated that the hole 36 located within the sleeve 34 only serves the function of restraining the ball when the peening tool is not in use and otherwise does not impede or interfere with the function of the peening tool when in operation.

In the preferred embodiment it was also found most desirable to use cylindrical keys 52 having a diameter equal to the diameter of the balls 32. In the preferred embodiment the diameter chosen was 0.125 inches for both the balls 32 and the cylindrical keys 52.

The dimensional relationship between the thickness of the cylindrical body 28, the diameter of the balls 32, the reduced diameter hole 36 located on the sleeve 34 and the diameter of the body 38 and the cylindrical keys 52 will be more fully illustrated in connection with FIGS. 5, 6 and 7.

Figure 5:
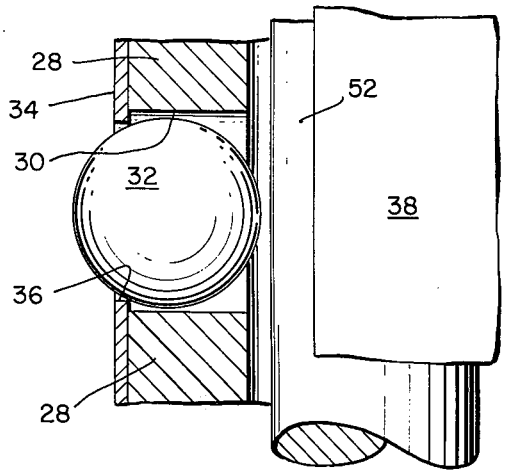
FIG. 5 is a partial cross-sectional view illustrating the dimensional relationship between the hole in the cylindrical body, the hole in the external sleeve member and the hammer pins located on the driver body.

Referring now to FIG. 5, there is shown a cut-away cross-section illustrating the total movement of the ball 32 within the confines of the cylindrical body 28. The ball 32 is shown contacting the reduced diameter hole 36 located within the sleeve 34 so as to prevent the ball 32 from being removed or leaving the hole 30 located within the cylindrical body 28. In the preferred embodiment the reduced diameter of the hole 36 is selected to allow a maximum projection of the ball 32 beyond the sleeve 34 of approximately a one-third diameter of the ball. In this position with the ball 32 against the reduced diameter hole 36 it will be observed that the ball does not contact the cylindrical key 52 located within the driver body 38.

FIG. 5 is intended to illustrate only the dimensional relationship and shows the maximum movement of the ball 32 when the peening tool 10 is not located within a hole to be peened.

Figure 6:
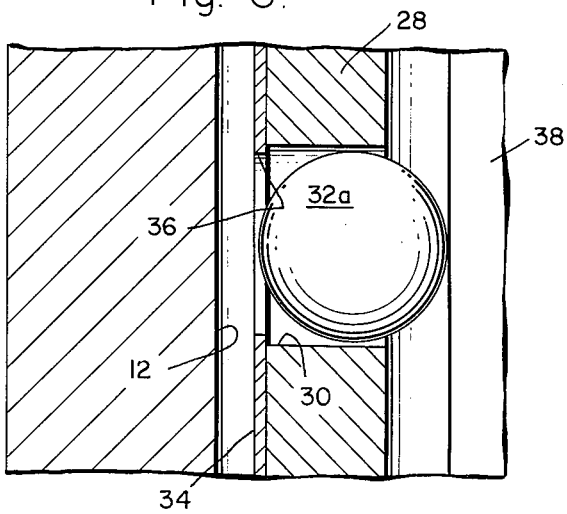
FIG. 6 is an exploded view illustrating the dimensional freedom of the individual ball bearing when not contacted by the hammer pins.

Referring now to FIG. 6, there is illustrated a partial cross-sectional view of the peening tool 10 located within a workpiece having a cylinder 12 to be peened.

FIG. 6 illustrates the driver body 38 contacting the ball 32*a* in a similar fashion as illustrated in connection with FIG. 3. The purpose of FIG. 6 is to show the dimensional relationship between the diameter of the driver body 38 and the ball 32*a* so as to illustrate the fact that the ball 32*a* is still trapped within the hole 30 located in the cylindrical body 28. It will be observed that the ball 32 in contacting the external diameter of the driver body 38 is free to move within the confines of the hole 30 but is otherwise restricted.

Figure 7:
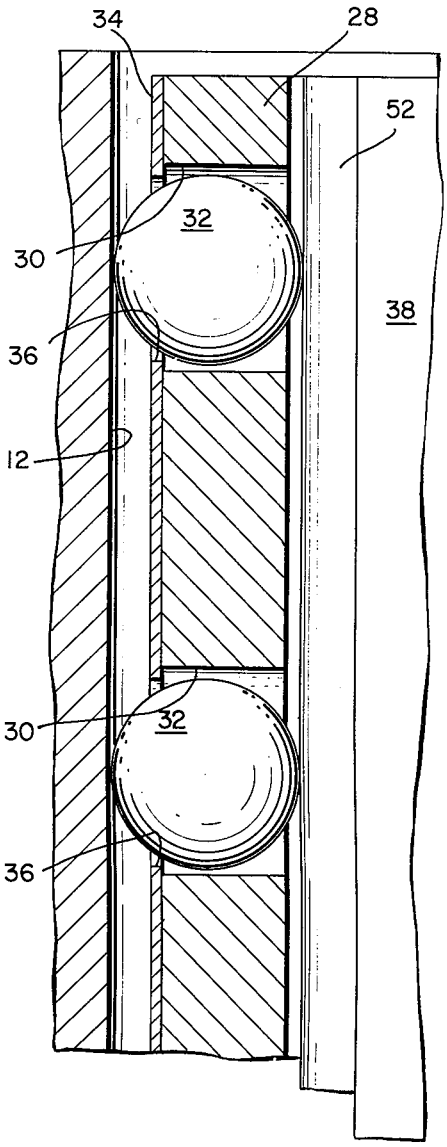
FIG. 7 illustrates the peening action of the individual balls on the internal diameter of a cylinder when the balls are impacted upon by the hammer pins.

Referring now to FIG. 7, there is shown an enlarged view of the peening tool 10 located within a workpiece having a cylinder 12 to be peened. The driver body 38 is located so as to force the cylindrical key 52 against the opposing balls 32 as more fully illustrated in FIG. 3.

The dimensions of the individual peening tool are of course proportioned to the internal diameter of the cylinder 12 to be peened. It will be appreciated that FIG. 7 is representative of the dimensional relationship that must exist between any size peening tool and any size diameter hole being peened. However, it will be appreciated that the same general dimensional relationship described in connection with these figures must exist for any given sized peening tool.

During the peening operation the driver body 38 is rotated causing the cylindrical key 52 to contact the balls 32 so as to force the balls radially outward and against the internal diameter of the cylinder 12. The total movement of the balls 32 will in the preferred operation cause a penetration depending on the material of the cylinder 12. It will be observed, however, that during the peening operation with the ball 32 forced into the wall of the cylinder 12 that the ball does not contact the reduced diameter 36 located in the sleeve 34. The operator of the peening tool simply moves the tool 10 vertically in an up and down direction while the rotary driving device 20 rotates the driver body 38 through the shaft 22. The resulting operation will produce a plurality of discrete hemispherical indentations in the internal diameter of the cylinder 12.

In the preferred embodiment, using steel ball bearings as the peening element having a diameter of 0.125 inch, it has been discovered that the external diameter of the complete peening tool should be approximately 0.002 to 0.004 inch smaller than the internal diameter of the hole to be peened. The dimensions will of course vary depending on the size of the hole to be peened and the depth of the indentations required.

Experience has shown that utilizing a single body construction allows a maximum number of ball bearings to be used. For example, utilizing a 0.125 inch diameter ball bearing allows a tool to have 15 holes on a circle that are located approximately 24° apart. The length of the tool is of course optional but for any given length more ball bearings can be made to impact upon the workpiece thereby producing a more efficient peening operation and at lower cost.

I claim:

1. A peening tool comprising:

a solid cylindrical body having a centrally located hollow portion defining a given body thickness, a plurality of holes in said body thickness located radially in said cylindrical body, said holes having a reduced diameter near the peripheral portion of said hollow cylindrical body, a spherically shaped ball located in each of said holes and having a diameter less than the largest diameter of said hole but greater than said reduced diameter and greater than said body thickness, and a rotatable driver body located within said hollow cylindrical body and having a plurality of individual rotatable hammers adapted to sequentially contact said balls.

2. A peening tool according to claim 1 which includes a shoulder portion of reduced diameter near said external diameter.

3. A peening tool according to claim 1 in which said spherically shaped ball is a steel ball bearing.

4. A peening tool according to claim 1 in which said solid cylindrical body is comprised of a first portion and a second portion, said first portion comprises a solid cylindrical body having an internal diameter and an external diameter defining a given thickness, and which includes a plurality of equal diameter holes in said thickness located radially in said cylindrical body, said second portion includes a plurality of axially aligned holes of reduced diameter.

5. A peening tool according to claim 4 in which said second portion comprises a solid cylindrical sleeve coaxial with the solid cylindrical body of said first portion, and in which said sleeve has a plurality of reduced diameter holes equal to and aligned with the equal diameter holes on the cylindrical body of said first portion.

6. A peening tool according to claim 5 in which said sleeve is fixedly attached to said solid cylindrical body to maintain the alignment of said reduced diameter holes on said sleeve with said equal diameter holes on said cylindrical body to form a unified contiguous body structure.

7. A peening tool according to claim 6 in which said sleeve has an internal diameter that is 0.002 to 0.003 inch greater than the external diameter of the cylindrical body of said first portion whereby said sleeve can slip over said first portion, and in which said sleeve is soldered in position onto said first portion to maintain said fixed relationship.

8. A peening tool according to claim 4 in which the diameter of each of said balls is greater than the combined thickness of said first portion and said second portion, and less than the diameter of said equal diameter holes.

9. A peening tool according to claim 1 in which said driver body contains a plurality of keyways each adapted to hold a key, and a key located in each keyway for contacting said balls.

10. A peening tool according to claim 9 in which said keyways are circular and said keys are circular for nesting within said keyways.

11. A peening tool according to claim 10 in which said circular keyways are located near the periphery of said driver body for allowing not more than a one-third diameter portion of said circular keys to extend beyond the diameter of said driver body.

12. A peening tool according to claim 10 in which the diameter of said circular keyways is greater than the diameter of said circular keys whereby each of said keys is free to rotate within said keyway.

13. A peening tool according to claim 10 in which the diameter of each of said balls and the diameter of each of said circular keys is the same.

14. A peening tool according to claim 10 in which each of said circular keys is a cylindrical steel pin.

15. A peening tool according to claim 1 in which the diameter of said drive body prevents removal of said balls between said plurality of hammers.

16. A peening tool according to claim 1 in which said individual hammers contact and move said balls, said total movement of said balls while being contacted by said individual hammers being less than the distance necessary to cause said balls to strike the reduced diameter of said hole.

17. A peening tool according to claim 1 in which said cylindrical body includes a main body portion at one end containing bearings for supporting said rotatable driver body and a removably attached bearing member at the other end of said body for supporting the opposite end of said driver body.

18. A peening tool comprising:

a solid cylindrical body having a centrally located hollow portion defining a given body thickness, a plurality of cylindrical holes located radially in said body, a spherically shaped ball located in each of said holes and having a diameter that is less than the diameter of said hole, and a sleeve member having a plurality of reduced diameter holes located coaxially over said cylindrical body with said reduced diameter hole in said sleeve juxtaposed over said larger diameter hole in said cylindrical body.

* * * * *